US008916024B2

(12) United States Patent
Ban et al.

(10) Patent No.: US 8,916,024 B2
(45) Date of Patent: Dec. 23, 2014

(54) METHOD AND SYSTEM FOR PRODUCING MARKET PULP AND PRODUCTS THEREOF

(71) Applicant: Buckman Laboratories International, Inc., Memphis, TN (US)

(72) Inventors: Weiping Ban, Memphis, TN (US); Philip M. Hoekstra, Memphis, TN (US); Michael R. Elsey, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 187 days.

(21) Appl. No.: 13/684,636

(22) Filed: Nov. 26, 2012

(65) Prior Publication Data

US 2013/0139980 A1 Jun. 6, 2013

Related U.S. Application Data

(60) Provisional application No. 61/565,547, filed on Dec. 1, 2011.

(51) Int. Cl.

| | |
|---|---|
| ***D21C 9/08*** | (2006.01) |
| ***D21H 21/10*** | (2006.01) |
| ***D21H 11/22*** | (2006.01) |
| ***D21H 17/42*** | (2006.01) |
| ***D21H 17/44*** | (2006.01) |
| ***D21H 17/20*** | (2006.01) |
| ***D21C 3/00*** | (2006.01) |
| ***D21C 9/00*** | (2006.01) |
| ***D21C 9/18*** | (2006.01) |
| ***D21H 11/20*** | (2006.01) |

(52) U.S. Cl.

CPC ..... *D21H 17/20* (2013.01); *D21C 3/00* (2013.01); *D21C 9/004* (2013.01); *D21C 9/005* (2013.01); *D21C 9/18* (2013.01); *D21H 11/20* (2013.01); *D21H 21/10* (2013.01)

USPC ..... 162/72; 162/182; 162/164.1; 162/164.6; 162/166; 162/167; 162/168.1; 162/168.2; 162/168.3

(58) Field of Classification Search

CPC ..... D21H 21/10; D21H 23/02; D21H 23/04; D21H 11/16; D21H 11/20; D21H 11/22; D21H 17/20; D21H 17/33–17/44; D21H 17/54–17/57; D21C 9/00; D21C 9/001; D21C 9/002; D21C 9/004; D21C 9/005; D21C 9/18

USPC ..... 162/56, 72, 158, 164.6, 168.2, 168.3, 162/182, 185, 168.1, 164.1, 166, 167

See application file for complete search history.

(56) References Cited

U.S. PATENT DOCUMENTS 4,749,444 A * 6/1988 Lorz et al. ..... 162/168.3
4,961,825 A * 10/1990 Andersson et al. ..... 162/175

(Continued)

FOREIGN PATENT DOCUMENTS

CA 2635661 A1 7/2007
EP 0184603 A1 6/1986

(Continued)

OTHER PUBLICATIONS

International Search Report and Written Opinion issued in corresponding International Patent Application No. PCT/US2012/066500 dated Apr. 2, 2013 (12 pages).

(Continued)

*Primary Examiner* — Eric Hug

(74) *Attorney, Agent, or Firm* — Kilyk & Bowersox, P.L.L.C.

(57) ABSTRACT

Methods and systems are provided for producing market pulp which include treatment of pulp with diverse ionic compounds before pulp drying. Cationically and anionically charged compounds can be used to treat pulp before pulp drying to improve pulp dewatering performance and efficiency in the production of market pulp. Market pulp products containing the treatment compounds are also described.

19 Claims, 5 Drawing Sheets

(56) References Cited

U.S. PATENT DOCUMENTS

| | | | | |
|---|---|---|---|---|
| 4,969,976 | A * | 11/1990 | Reed | 162/164.3 |
| 5,423,946 | A | 6/1995 | Sarkar et al. | |
| 5,958,180 | A | 9/1999 | Hubbe et al. | |
| 6,074,524 | A * | 6/2000 | Wu et al. | 162/100 |
| 6,168,686 | B1 * | 1/2001 | Sutman et al. | 162/142 |
| 6,228,217 | B1 * | 5/2001 | Dickerson et al. | 162/158 |
| 7,306,700 | B1 | 12/2007 | Hallstrom et al. | |
| 7,318,881 | B2 | 1/2008 | Lindgren et al. | |
| 2003/0192659 | A1 | 10/2003 | Yancey et al. | |
| 2004/0118540 | A1 * | 6/2004 | Garnier et al. | 162/164.1 |
| 2004/0144510 | A1 | 7/2004 | Mauler | |
| 2006/0124264 | A1 * | 6/2006 | Kokko et al. | 162/167 |
| 2008/0073043 | A1 * | 3/2008 | Greschik et al. | 162/17 |
| 2009/0255876 | A1 * | 10/2009 | Dunbar | 210/709 |
| 2010/0084103 | A1 | 4/2010 | Reinicke | |
| 2010/0089541 | A1 | 4/2010 | Reinicke | |
| 2011/0048660 | A1 | 3/2011 | Esser et al. | |

FOREIGN PATENT DOCUMENTS

| | | | |
|---|---|---|---|
| EP | 0790351 | A2 | 8/1997 |
| GB | 1177512 | A | 1/1970 |
| WO | 02072499 | A2 | 9/2002 |
| WO | 2004061201 | A1 | 7/2004 |
| WO | 2010089334 | A1 | 8/2010 |
| WO | 2010145956 | A1 | 12/2010 |

OTHER PUBLICATIONS

CAPLUS Abstract, AN 2006:1061313, Bessonoff, M., et al., "Effects of A-PAM/C-PAM complexes on retention, formation and dewatering of papermaking pulp", Ann. Mtg. Reprints—Pulp and Paper Technical Association of Canada, 92nd, Feb. 2006, vol. A, pp. 117-121, Publ.: Pulp & Paper Techn. Assoc. of Canada.

CAPLUS Abstract, AN 2007:1425894, Lapin, V. V., et al., "An effective intensifier for flocculation of recycled wastepaper pulp," Tsellyuloza, Bumaga, Karton, 2007, (10), pp. 54-57.

CAPLUS Abstract, AN 2005:743026, Bobu, E., et al., "The bentonite and micropolymer as anionic components in microparticle retention systems," Professional Papermaking, 2005, No. 1, pp. 30-34, publ.: Deutscher Fachverlag GmbH.

Nanko, H., et al., "The World of Market Pulp", 2004, WOMP LLC, pp. 1, 7, 21, 35, 53, 67 and 68.

Biermann, C.J., Handbook of Pulping and Papermaking, Second Ed., 1996, Academic Press, pp. 97.

Smook, G.A., Handbook for Pulp and Paper Technologist, Third Ed., 2002, Angus Wilde Publ., pp. 41-44.

* cited by examiner

METHOD AND SYSTEM FOR PRODUCING MARKET PULP AND PRODUCTS THEREOF

This application claims the benefit under 35 U.S.C. §119 (e) of prior U.S. Provisional Patent Application No. 61/565,547, filed Dec. 1, 2011, which is incorporated in its entirety by reference herein.

BACKGROUND OF THE INVENTION

The present invention relates to the production of market pulp. More particularly, methods and systems are provided for producing market pulp which include treatment of pulp with diverse ionic compounds before pulp drying.

In the pulp making industry, cellulose-containing feed material has been defibrated chemically, mechanically, or both, and then typically is washed and at least partly dewatered after such operations. In pulping processes in which the pulp is chemically treated, such as by chemical digestion, bleaching, or other chemical treatments, dewatering can be used to drain water and separate free chemical from the fibers. Some pulp mills may be integrated with a paper making plant, wherein the dewatering of the product pulp may be limited such that slurry pulp or wet laid pulp can be directly advanced to a papermaking machine at the same production site. Other pulp mills produce market pulp in non-integrated production operations. Market pulp can be pulp product which has been significantly dewatered in the final stages of pulp processing. Market pulp further may be formed into bales or rolls of dewatered pulp. The market pulp can be transported to other locations for later use.

The present investigators have realized that the rate at which pulp dewatering can be accomplished in a pulp mill in the production of market pulp can significantly affect the overall line speed and production capacity of the pulp mill or similar production facility. The present investigators have realized that there is a need for new methods and systems for producing market pulp with enhanced pulp-dewatering performance and efficiencies.

SUMMARY OF THE PRESENT INVENTION

A feature of the present invention is to provide a method for producing market pulp with treatment of pulp with cationic and anionically charged compounds to improve dewatering performance and efficiency.

Another feature of the present invention is to provide a method for producing market pulp by sequentially adding cationic and anionic polymers to pulp before dewatering to form a polyelectrolyte complex in the pulp to improve pulp drainage.

An additional feature of the present invention is to provide a system for producing market pulp capable of using cationic and anionically charged compounds before pulp drying to improve pulp drainage.

A further feature of the present invention is to provide a market pulp comprising dewatered pulp which contains cationically and anionically charged compounds from the pulp treatment method.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates, in one embodiment, to a method for producing market pulp comprising forming cellulosic particulates into pulp; adding cationically charged compound and anionically charged compound to the pulp to provide treated pulp; mechanically dewatering the treated pulp to provide mechanically dewatered pulp; and thermally drying the mechanically dewatered pulp to form market pulp.

The present invention further relates to a method for producing market pulp comprising forming cellulosic particulates into pulp; adding cationic polymer and anionic polymer to the pulp effective to form a polyelectrolyte complex in the pulp before dewatering; mechanically dewatering the pulp; and thermally drying the dewatered pulp to form market pulp.

The present invention further relates to a system for producing market pulp comprising a supply of cellulosic fibers; at least one pulp forming unit for forming pulp from the cellulosic fibers; at least one feeding device for feeding cationically charged compounds, such as cationic polymer, to the pulp; at least one feeding device for feeding anionically charged compound, such as anionic polymer, to the pulp capable of forming a polyelectrolyte complex in the pulp; a dewatering device for mechanically removing water from the pulp; and a dryer for thermally removing water from the pulp to provide market pulp.

The present invention further relates to a market pulp comprising dewatered pulp which contains cationically charged compound and anionically charged compound from the indicated treatment method.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the embodiments of the present invention and together with the description, serve to explain the principles of the present invention.

DETAILED DESCRIPTION OF THE PRESENT INVENTION

Figure 1:
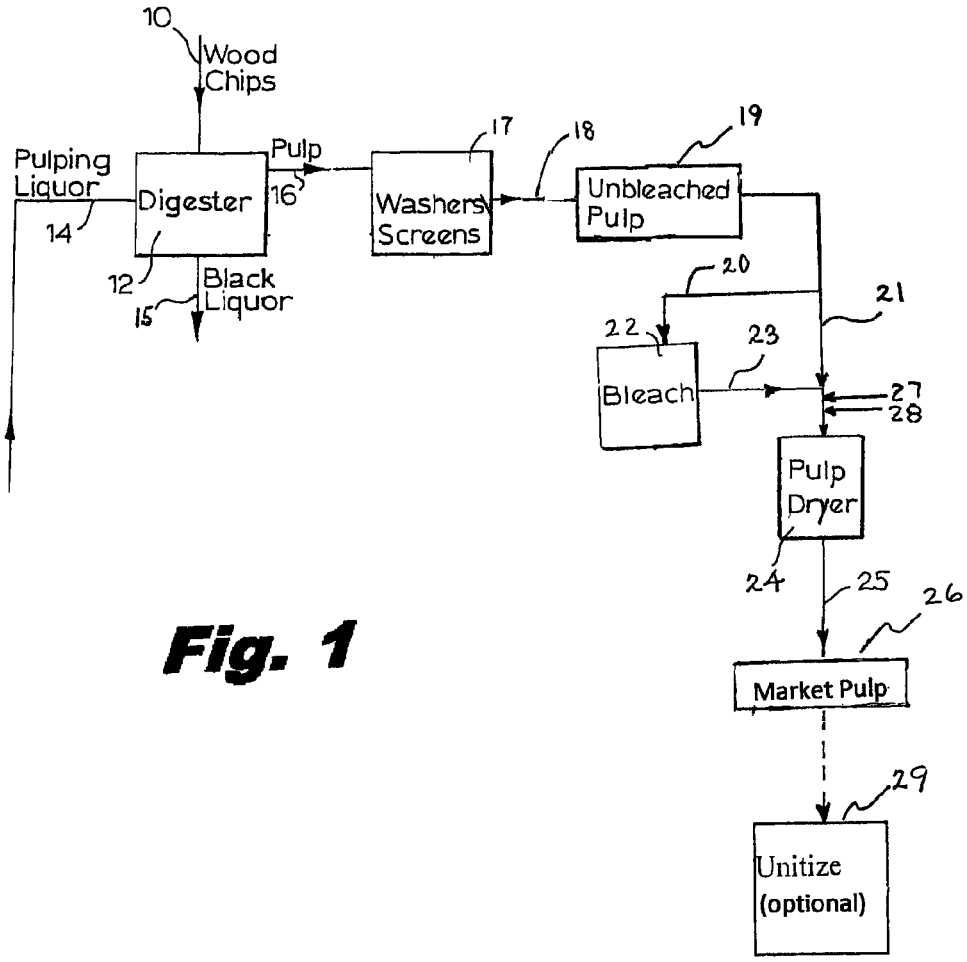
FIG. 1 is a process flow chart for producing market pulp according to an example of the present application.

The present invention relates to production of market pulp which has been treated with cationically and anionically charged compounds to improve pulp dewatering performance and efficiency thereof. As used herein, "market pulp" refers to mechanically dewatered pulps which are thermally dried. The market pulp provides a dry form of product material which has useful storage stability and can be more easily shipped and handled than bulkier aqueous forms of pulp product. The market pulp can be stored, transported, or both for subsequent use as a process material used in other production processes. The market pulp optionally can be securely wrapped as a unitized product for shipping or transport for further processing, such as papermaking. As an option, market pulp, as referenced herein, can be a product of a modified type of pulp mill which is adapted according to options of the present invention for treatment of the pulp after any bleaching and before final dewatering with the cationically and anionically charged compounds. These treatment compounds impact the dewatering performance in significant and beneficial ways which would not be expected from the use of either type of ionic compound individually, and in some options may exceed additive expected effects from the individual components. It has been observed that the high basis weight of some pulp sheets on a pulp dryer, for example, can be an impediment to good drainage. It has been found that significant improvements in dewatering performance at a pulp dryer can be provided in the production of market pulp by treatment of pulps after digestion or other mode of defibration, and any bleaching, and before pulp drying, with cationically and anionically charged compounds. Treatment of the pulp prior to the pulp dryer with the combination of the diverse ionic compounds, for example, can increase the free drainage rate of the pulp. Increasing the free drainage rate of the pulp makes it feasible to increase the production speed and capacity of the process for producing market pulp. As an option, the pulp treatment methods and systems of the present invention are not part of, nor integrated with, a paper making machine.

As an option, the pulp treatment compounds used in the production of market pulp according to methods of the present invention can be a combination of cationic and anionic polymers, or a combination of inorganic cationically and anionically charged compounds, or mixed combinations of cationically and anionically charged polymers and inorganic compounds. As an option, through combining cationic polymer and anionic polymer with the pulp before pulp dewatering, the different types of ionic polymers can form a polyelectrolyte complex in the pulp before the pulp is dewatered in the production of market pulp. It is believed that an in situ formation of the polyelectrolyte complex in the pulp before dewatering beneficially influences the drainage and dewatering behavior of the treated pulps. Cationic and anionic complex-forming polymers, for example, can be added to pulp sequentially by separate additions thereof at different process locations or at different times at the same process location, or they can be added concurrently at least in part at the same process location (e.g., as separate feeds or as a pre-mixture). As an option, market pulp can be produced in more efficiently by sequentially adding at least about 80% up to 100% of the total added amount of a cationic polymer or other cationically charged compound before addition of an anionic polymer or other anionically charged compound to the pulp before dewatering the pulp. In such an option, the cationic polymer is given opportunity to interact first with the pulp fibers before interactions are made with the anionic polymer. The addition of the ionic polymers in this sequence (i.e., cationic first, then anionic) can magnify the enhancements in dewatering performance that can be achieved, as compared, for example, to the opposite addition sequence (i.e., anionic polymer first, then cationic polymer) or simultaneous addition. As compared to pulp drainage seen without the addition of the cationic and anionic polyelectrolyte complex-forming polymers to the pulp, pulp drainage performance in the production of market pulp can be significantly increased, such as by a factor of three or more, by generating the polyelectrolyte complex with processes of the present invention. Further, as compared to use of only one of the types of ionic polymers, such as only the cationic polymer, to treat the pulp, drainage efficiencies for similar total polymer addition amounts can be significantly increased, such as by about 60 to about 200%, or other increases, by the sequential addition of cationic and anionic polyelectrolyte complex-forming polymers, in that order, to the pulp. Further, the use of combinations of different types of cationic polymers having different molecular weights for the cationic polymer used in the sequential addition with an anionic polymer can provide drainage rates that exceed the sum of the individual drainage rates obtained from use of the cationic polymers individually to treat a pulp. Better drainage in the wire section of the pulp dryer can lead to reduced moisture of pulp in the press section, and as a result, steam consumption in the drying section can be significantly reduced, which can provide energy savings. Further, improvements of pulp dewatering provided by treatment of digested pulp with the cationic and anionic polymers prior to pulp drying can allow for faster pulp throughout rates or speeds in the pulp mill, whereby the productivity of the pulp mill can be increased. A suitable amount of pulp dewatering also may be provided at a reduced total polymer addition rate as compared to what may be predicted as needed if using a cationic polymer alone. Free drainage properties of the pulps treated with the cationic and anionic polymers before pulp drying also can demonstrate good correlations with water retention properties, such as in terms of water retention values or WRV, of the treated pulps, which indicates that the treatment can yield reliable nonrandomized results.

As an option, an amount of polyelectrolyte complex formed by addition of a cationic polymer and an anionic polymer to pulp before dewatering in the production of market pulp is effective to provide at least one of the following:

(i) increased pulp free drainage (g/60 sec) to a value which is at least three times greater, or at least four times greater, or at least five times greater, than free drainage value obtained without the complex formed/present in the pulp;

(ii) increased pulp free drainage to a value which is at least about 50%, or at least about 60%, or at least about 75%, or at least about 100% greater than free drainage value obtained with using the cationic polymer individually in the pulp (without the anionic polymer);

(iii) increased pulp free drainage to a value which is at least about 10% greater, or at least about 15% greater, or at least about 20% greater, or at least about 25% greater, or at least about 30% greater, or at least about 40% greater, or least about 50% greater than a free drainage value calculated as a sum of the free drainage increases obtained from using the anionic polymer and cationic polymer separately and individually in the pulp; and (iv) reducing pulp water retention value (WRV) to a value which is at least about 10% less, or at least 15% less, or at least about 20% less, or at least about 25% less than WRV obtained with using the cationic polymer individually in the pulp (without the anionic polymer). In calculating the percentage values for (i), (ii), (iii), and (iv), the denominator values of the fractions are based on the values for the pulps treated with only one or none of the cationic and anionic polymers, and the numerator values are the absolute values of the difference between the property value for the cationic and anionic polymer-treated pulp and the pulp treated with only one or none of the ionic polymers.

As another option, an amount of polyelectrolyte complex formed by sequential addition of a combination of different cationic polymers, e.g., a cationic polyamine of low molecular weight (e.g., MW≤500,000), and a high molecular weight copolymer containing acrylamide with a cationic monomer (e.g., MW>500,000), and an anionic polymer to pulp before dewatering in the production of market pulp can be effective to provide increased pulp free drainage to a value which is at least about 10% greater, or at least about 15% greater, or at least about 20% greater, or at least about 25% greater, or at least about 30% greater, or at least about 40% greater, or least about 50% greater than free drainage value as calculated as a sum of the free drainage increases obtained from using the cationic polymers separately and individually in the pulp as sequentially added before the anionic polymer. The reference to MW throughout this application is a reference to weight average MW in Daltons. The difference in "low" MW and "high" MW can be at least 10,000 or at least 50,000 MW.

The methods of the present invention can be used to improve dewatering of pulpable materials, including cellulosic pulpable materials, noncellulosic pulpable materials, recycled paper waste pulpable materials, or any combinations thereof. As an option, the cellulosic pulpable materials can be lignocellulosic. The drainage and dewatering improvements due to the pulp treatment with the cationically and anionically charged compounds according to methods and systems of the present invention is not limited to treating any particular type of pulp and can find application in all grades of pulp. The treatable pulps can be chemical pulps, mechanical pulps, or combinations of these types of pulps. As an option, the treatable pulp is a chemical pulp at least in part. The treatable pulp can be bleached or unbleached when treated. The treatable pulp can include, for example, Kraft pulp, dissolving pulp, fluff pulp, semichemical pulps (e.g., bleached chemothermomechanical pulp or BCTMP), sulfite pulp, soda pulp, organosols pulp, polysulfide pulp, or other pulps, and any combinations thereof. Nonchemical mechanical pulps, such as pulps mechanically defibrated only, such as by use of disk or conical refiners only for defibration of feedstock, also can be processed with the indicated pulp treatment.

As used herein, "dried pulp" refers to laid, stacked, piled or otherwise physically accumulated pulp which is sufficiently dewatered to be exposed to air and unsuspended and non-immersed in aqueous medium.

"Polyelectrolyte complex" or "PEC" refers to a polymer-polymer complex which has both the properties of a macromolecule and the charge possibilities of an electrolyte, wherein polycations and polyanions can interact and form precipitates (i.e., a polyelectrolyte complex or "PEC"). A polyelectrolyte complex also may be referred to herein as a polysalt. Polyanions and polycations can co-react in aqueous solution of pulp and form the polysalts in a complexation process. The polysalts can be at least partly or fully water soluble at pulp processing conditions (e.g., pH, consistency, polymer concentrations, temperature, and so forth).

"Cationically charged compound" refers to a compound having a net positive charge on the molecule in aqueous solution. The cationically charged compound can be organic or inorganic.

"Cationic polymer" refers to a polymer having a net positive charge on the molecule in aqueous solution. Accordingly, the cationic polymer can have only cationic moieties as the charged groups thereon or may be amphoteric with a net cationic charge for the overall molecule.

"Anionically charged compound" refers to a compound having a net positive charge on the molecule in aqueous solution. The anionically charged compound can be organic or inorganic.

"Anionic polymer" refers to a polymer having a net negative charge on the molecule in aqueous solution. Accordingly, the anionic polymer can have only anionic moieties as the charged groups thereon or may be amphoteric with a net anionic charge for the overall molecule.

"Amphoteric polymer" is a polymer having both cationic and anionic ionic charge moieties. An amphoteric polymer may be one including cationic and anionic monomeric units in the polymer chain, or which may comprise cationic and anionic functionalization groups along the chain or at end groups, or both. For example, monomeric units having amine or amide bearing monomeric units can be cationic, whereas monomeric units having carboxylic bearing monomeric units can be anionic. The relative mole percentages and charge strengths of each type of ionic group can affect the overall net charge of the amphoteric polymer. The net charges or charge densities (Mütek) of ionized polymers can be measured using known methods and techniques, such as a colloid titration method used for this determination.

"Kraft pulp" refers to chemical wood pulp produced by digesting wood by the sulfate process.

"Fluff pulp" refers to a chemical, mechanical or combination of chemical/mechanical pulp, usually bleached, used as an absorbent medium in disposable diapers, bed pads, and other hygienic personal products. Fluff pulp is also known as "fluffing" or "comminution" pulp.

"Dissolving pulp" refers to a higher purity, special grade pulp made for processing into cellulose derivatives including rayon and acetate.

"Bleached chemothermomechanical pulp" or "BCTMP" refers to bleached CTMP. "CTMP" refers to chemical-mechanical pulp produced by treating wood chips with chemicals (e.g., sodium sulfite) and steam before mechanical defibration.

"Unitize" refers to a process by which a plurality of market fibers can be bundled or packaged together as a single unitary product for handling.

"Defibration" refers to separation of wood fibers by mechanical means, chemical means, or combinations of both.

Referring first to FIG. 1, wood chips, or other comminuted cellulosic or noncellulosic fibrous material, are fed by line 10 to a continuous digester 12 or one or several batch digesters wherein the pulp is subjected to the pulping action of pulping liquor fed thereto by line 14. This option can be described, for example, with particular reference to a kraft process applied to virgin lignocellulosic fibrous material, wherein digested and optionally bleached pulp is treated with cationic and anionic polymers before the kraft pulp is dried and unitized. It will be understood that the invention also is applicable to other pulping procedures with appropriate modification to take into account the treatment of the pulp with cationic and anionic polymers (or other cationically and anionically charged compounds) before the pulp is dried. As an option, in the kraft process, the active pulping chemicals can be sodium hydroxide and sodium sulfide, which is also known as white liquor, and these chemicals can be contained in the pulping liquor fed by line 14. The digester can operate in batch or continuous manner. There are generally known variations of the cooking processes both for the batch and the continuous digesters which can be applied. In a continuous digester, for example, the wood chips or other particulated feedstock materials can be fed at a rate which allows the pulping reaction to be complete by the time the materials exit the reactor.

As an option, delignification may require, for example, cooking at several hours, such as at about 100 to about 200° C. (266 to 356° F.), or other temperature and cooking time conditions suitable for the feedstock and digestion chemicals used for digestion. Typically, the finished cooked wood chips are blown by reducing the pressure to atmospheric pressure. This releases steam and volatiles. As an option, after the digestion, the resulting cooked wood pulp containing residual spent pulping liquor can pass by line 16 to a brown stock washing zone 18. The washing zone 18 can be used for washing the digested chips free from entrained spent pulping liquor and screening out unwanted material. Screening of the pulp after pulping can be a process whereby the pulp is separated from large shives, knots, dirt and other debris. The "accept" is the pulp which can be further processed according to the present invention, and the material separated from the pulp is "reject." The brown stock from the blowing can go to washing stages where the used cooking liquors are separated from the cellulose fibers. Typically, a pulp mill may have multiple washing stages in series. The spent pulping liquor, or black liquor 15, may be fed to a recovery and regeneration zone (not shown), which can be operated according to conventional methods.

As an option, the pulp in line 16 can be subjected to washing in the brown stock washing zone 17, such as, for example, by successive passage through washers and screens before discharge of the unbleached pulp 19 from the brown stock washing zone 17 by line 18. As an option, the unbleached pulp can be bleached at a bleach plant 22 before the resulting bleached pulp is dried at a pulp dryer 24 to provide market pulp 30. In the bleach option, unbleached pulp 19 is fed to a bleach plant 22 through line 20. As an option, pulp leaving a digester wash unit may retain a dark brown color due to residual lignin content that it is desired to bleach out, which can depend on the intended end use. If bleached, conventional bleaching processes can be used on the pulp. As an option, in the bleach plant 22, the pulp can be subjected to one or a plurality of bleaching, caustic extraction, and washing operations, which can result in further delignified and bleached pulp of an increased brightness. The bleaching treatment chemicals can be, for example, oxygen gas, ozone, chlorine dioxide, chlorine, peroxide, pure acid or a suitable alkali for an extraction step, or a mixture of these, and possibly other bleaching chemicals or additives. For example, pairs of chlorine dioxide and caustic extraction towers followed by pulp washing stages may be used for bleaching, or other conventional pulp bleaching arrangements may be applied to the pulp.

The bleached pulp can be discharged from the bleach plant 22 by line 23 for passage to the pulp dryer 24. As another option, as indicated by line 21 in FIG. 1, the unbleached pulp can be fed directly from the washing zone 17 to the pulp dryer 24 without any intervening bleaching of the pulp. For example, in the case of a plant designed to produce pulp to make brown sack paper or linerboard for boxes and packaging, and the like, the pulp may not need to be bleached to a high brightness. The pulp dryer 24 can dewater and thermally dry the bleached or unbleached pulp to provide dried pulp in line 25 which is market pulp. The pulp dryer 24 can include, for example, a mechanical dewatering section and a thermal drying section, which are described in further details and illustrations with respect to other figures herein. The market pulp 26 can be in the form of continuous dried pulp sheets, for example, or other dried forms of pulp discharged from the pulp dryer 24.

As an option, cationic and anionic polymers, or other cationically and anionically charged compounds, are added to treat the pulp before the pulp is dewatered and dried in pulp dryer 24. As an option, cationically charged compound can be added to the pulp at feed line 27 and anionically charged compound can be added at feed line 28 at the inlet side of the pulp dryer 24. The addition of the cationically and anionically charged compounds to the pulp before dryer 24 can improve dewatering performance at the dryer 24. As an option, for bleached pulp, the cationically and anionically charged compounds can be added to the pulp anywhere after the bleach plant 22 and before dryer 24. As another option, for unbleached pulp, the cationically and anionically charged compounds can be added to the pulp anywhere after the digester 12 and before dryer 24. As an option, the anionically charged compound is added to the pulp no earlier than the addition of the cationically charged compound to the pulp. As an option, the anionically charged compound is added to the pulp at times which can partially overlap with the addition times of the cationically charged compound provided that no addition of the anionically charged compound precedes the earliest addition of the cationically charged compound to the pulp on the production line. As an option, all amounts of the anionically charged compound are added to the pulp after the addition of all amounts of the cationically charged compound to the pulp. As an option, about 80% to 100%, or from about 85% to 100%, or from about 90% to 100%, or from about 95% to 100%, of the total weight amount of cationically charged compound added to the pulp is added to the pulp prior to the earliest adding of the anionically charged compound to the pulp. Additional details and illustrations on the addition of the indicated treatment compounds to the pulp before the dryer are provided in discussions of other figures herein.

The market pulp 26 discharged from pulp dryer 24 optionally can be unitized at station or stations 29. As an option, to unitize the market pulp, the dried pulp from the pulp dryer is formed into bales or rolls, or other securable large scale units of the pulp fibers. The mode of unitization of the market pulp is not necessarily limited as long as a bale, roll or other bundle of dried pulp fibers is secured together as a single unitary product for transport and handling. As an option, continuous dried pulp sheets can be produced by the pulp dryer which can be formed into bales or rolls. As an option, continuous dried pulp sheets formed at a pulp dryer can be cut into pieces and stacked into bales. The pulp bales can be compressed, wrapped, and tied into secure bundles for storage and transport. Both sheeted bales and flash dried bales can be unitized for handling and shipment. As an option, the unitizing can comprise wire or strap-tying bales of cut sheets of the dried pulp, or wire or strap-tying flash-dried bales of the dried pulp. For example, as an option, a unit of about 7 to 9 bales can be securely wire-tied with 6 to 9 strands of heavy steel wire. The unitized sheeted bales or flash dried bales of dried pulp provide unitized market pulp. A sheeted bale may have a weight of about 250 kg or other weights, which may measure approximately 27 to 32 inches wide, 35 to 37 inches long, and 17 to 18 inches high, of other dimensions. Flash dried bales that are less densely pressed also may be provided which may weigh about 195 to about 200 kg, or other weights. Other sizes and weights of bales of dried pulp may be unitized. As another option, as indicated, market pulp can be unitized as rolls or reels. For example, rolls of the market pulp can be formed which may measure from about 7 to about 55 inches in width and from about 58 to 60 inches in diameter, or other dimensions. The rolls of pulp optionally can be wrapped with removable cover sheeting, wire or strap tied, or both. As an option, the market pulp can be stored and/or transported in a non-unitized or a unitized form to paper mills which are on-site or off-site with respect to the pulp mill where the market pulp is produced. The market pulp can be used in paper manufacture, such as by reslurrying the dried pulp for papermaking processing or other uses.

Figure 2:
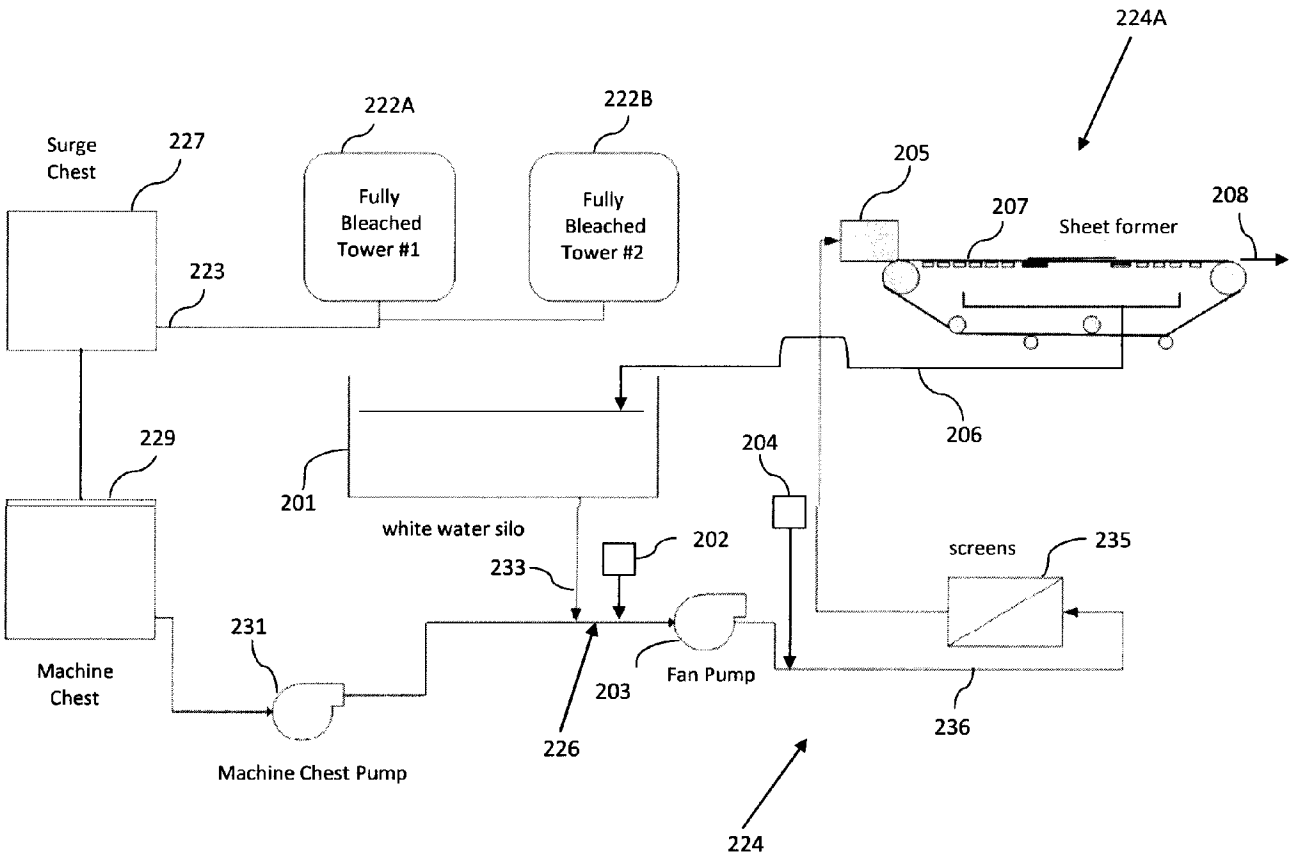
FIG. 2 is a schematic showing a portion of the system in FIG. 1 which includes a pulp dryer for bleached pulp according to an example of the present application.

FIG. 2 shows further details on a portion of a bleached pulp dryer 224 and an associated pulp feeding and pretreatment system according to an option of the present invention. Bleached pulp is drawn from one or more bleach towers 222A, 222B at the bleach plant (e.g., bleach plant 22 in FIG. 1), and transmitted through line 223 to a surge chest 227 and from there to a machine chest 229. The bleached pulp can be mixed in surge chest 227 until a substantially uniform dispersion is achieved. The bleached pulp in surge chest 227 can be transmitted to the machine chest 229. The machine chest 229 can be a consistency leveling chest which provides a retention time for the pulp which can be enough to allow variations in consistency entering the chest to be leveled out in a generally known manner. The pulp contents of the machine chest 229 can be feed into a pulp dryer section 224 via a machine chest pump 231.

The pulp dryer section 224 can include a mechanical dewatering section 224A and a thermal drying section (not shown in this figure). Of these sections, only a portion of the mechanical dewatering section 224A is shown in FIG. 2 with additional information on this section and other subsequent processing sections provided in the discussion of other figures herein. As an option, the pulp pumped from the machine chest pump 231 can be mixed and diluted with white water 233 from a white water silo 201 to form a stream of diluted pulp 226. The pulp 226 is pumped by pump 203 through a centriscreen 235 to a head box 205 from which pulp is sprayed or otherwise deposited onto wire 207. As an option, the pump 203 can be a centrifugal pump known as a fan pump. The pulp 208 collected on the wire 207 is advanced onto a wet press (not shown) for further dewatering of process water, and then thermal drying and unitization, which are described in greater detail with respect to other figures herein. As an option, the white water silo 201 can form part a white water recirculation loop including lines 206 and 233 and silo 201, such as shown in FIG. 2, which is integrated with the mechanical dewatering section 224A of the pulp dryer 224. For example, filtrate 206, also referred to herein as the white water, which is drained from the wire 207 can be recirculated to the white water silo 201 for reuse as the whitewater 233 combined with fresh pulp to form the combined stream of pulp 226.

The treatment of the pulp 226 can include one or more introduction point or points for each of the cationic and anionic polymers, or other cationically and anionically charged compounds, before the resulting treated 236 pulp reaches the head box 205 and wire 207. As an option, the cationically charge compound is added to the pulp before the anionically charged compound, such as illustrated in FIG. 2. For example, the cationically charged compound can be added at the inlet side of the fan pump 203, and the anionically charged compound can be added at the discharge side of the fan pump 203. As an option, this sequence of addition of the cationically and anionically charged compounds can be provided at other locations between the bleach towers 222A, 222B and the head box 205 of the mechanical dewatering section 224A. As indicated, the wet fiber sheet formed from the treated pulp as collected on the wire 207 can be further drained and mechanically pressed as part of the mechanical dewatering section, and then the screened and pressed pulp can be thermally dried, before the resulting dried pulp is conveyed to a unitizing station or stations.

Figure 3:
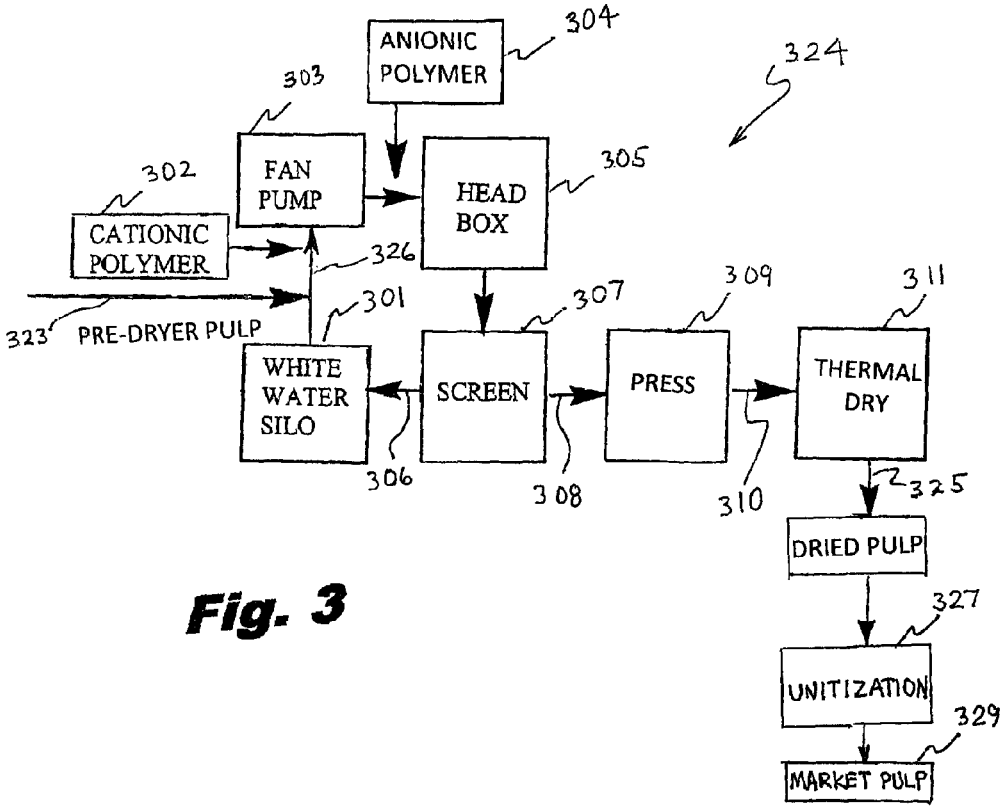
FIG. 3 is a schematic of a pulp dryer which can be used in the system shown in FIG. 1 according to an example of the present application.

Referring to FIG. 3, as an option, digested and optionally bleached pulp slurry 323 is combined with white water from a white water silo 306 and the resulting diluted pulp 326 can be pumped via a fan pump 303 to head box 305. As an option, cationic polymer from a cationic polymer supply and feeding device 302 can be added to the pulp 326 at the inlet side of the pump 303 and anionic polymer from an anionic polymer supply and feeding device 304 can be added at the outlet side of the fan pump 303. As an option, the added cationic and anionic polymers can form a polyelectrolyte complex in the pulp, such as provided by dilution of thicker stock digested (and optionally bleached) pulp with white water of the wire (screen). The polyelectrolyte complex can interact with pulp fibers and contents while the pulp is fed towards the head box by the pumping action of the fan pump and before being discharged from the head box onto the wire or screen for dewatering. The polyelectrolyte complex can interact with pulp fibers sufficient to significantly improve drainage and dewatering efficiencies of the pulp on the wire as compared to the same pulp without polyelectrolyte complex or the pulp treated with only the cationic polymer but not the anionic polymer.

From the headbox 305, the pulp can be sprayed onto wire 307 where the pulp slurry is dewatered and forms a wet sheet of pulp fiber. As an option, the pulp can be supplied to the headbox at consistencies between 0.1% and 5% solids, or from about 0.5% to about 3% solids, or from about 1% to about 2.5% solids. The pH of the treated pulp supplied to head box 305 can be, for example, from about 4 to about 9, or from about 4.5 to about 8.0, and can be controlled within these ranges with addition of pH modifiers, if desired or necessary. As an option, the pulp can exit the headbox 305 through a rectangular opening of adjustable height called the slice, which stream lands and spreads on wire 307. The wire may be a foraminous continuous metal screen or plastic mesh which travels in a loop. The wire can be, for example, a flat wire Fourdrinier, a twin wire former, or any combinations of these. Low vacuum boxes and suction boxes may be used with the wire in conventional manners. As an option, the sheet consistency of the pulp after dewatering on the wire may be for example, from about 2% to about 35%, or from about 10% to about 30%, based on % solids content, or other values. Conventional wire or screen devices for dewatering pulp may be adapted for use in the methods and systems of the present invention. The filtrate portion 306, also referred to herein as white water, which is drawn and drains through the wire 307 can be recirculated to the white water silo 301, as indicated, and then can be combined with fresh pulp 323 before the resulting diluted pulp 326 is pumped to the head box 305.

The pulp 308 which is collected on wire 307 can be passed forward to a wet-press section 309. Additional water can be pressed and vacuumed from the pulp 308 at wet-press section 309. As an option, press section 309 can remove water from the pulp with a system of nips formed by rolls pressing against each other aided by press felts that support the pulp sheet and can absorb the pressed water. A vacuum box, such as a Uhle box, optionally can be used, for example, to apply vacuum to the press felt to remove the moisture so that when the felt returns to the nip on the next cycle, it does not add moisture to the sheet. As an option, the pulp sheet can be passed through a series of rotating rolls ("presses") that squeeze out water and air until the fiber consistency of the pulp sheet is from about 40 to about 50%. As an option, the pressed pulp can comprise up to about 50% solids after pressing, or from about 20% to about 45% solids, or other values.

The screened and pressed pulp 310 can be moved to a thermal dryer section 311 for evaporative drying. Heat can be used at thermal dryer section 311 to remove additional water, such as by evaporation. As an option, the pulp 310 can be dried in the thermal dryer section 311 at a temperature in the range of 60° C. to 127° C. (140° F. to 260° F.) to remove more water. As an option, the thermal dryer can have, for example, a series of internally steam-heated cylinders that evaporate the moisture of the pulp as the pulp is advanced over the heated cylinders. As an option, a pressed pulp sheet can be floated through a multi-story sequence of hot-air dryers until the consistency is from about 80% to about 97% consistency, or from about 85% to about 95%, or other values. As an option, the dried pulp leaving the pulp dryer has an absolute moisture content (i.e., total $H_2O$ content based on total weight of pulp) of less than about 20% by weight, or less than about 15% by weight, or less than about 10% by weight, or from about 5% to about 20% by weight, or from about 5% to about 10% by weight. For example, dried pulp containing 12 total parts by weight water (all forms) and 100 parts by weight dry pulp fiber has an absolute moisture content of 10% by weight (i.e., 12/(12+100)*100).

The dried pulp 325 exiting the thermal dryer 311 is market pulp 326. As an option, market pulp 326 provided by the thermal drying can be in the form of continuous dried pulp sheets.

As an option, the indicated cationically charged compounds and anionically charge compounds used to treat the pulp to improve dewatering performance can be water soluble or water dispersible compounds. As an option, these ionic compounds are water soluble polymers. As an option, the cationic polymers which can be used as a cationically charged compound to treat the pulp in methods of the present invention can be at least one of the following:

- copolymers containing acrylamide with a cationic monomer, such as 2-[(methacryloyloxy)ethyl]trimethyl ammonium chloride, 3-(N,N,N-trimethylammonium) propylacrylamide chloride, 2-(N,N,N-trimethylammonium)ethylacrylate chloride, 2-(N,N,N-trimethylammonium)ethylmethacrylate chloride, 2-(N,N-dimethyl-N-benzylammonium)ethylacrylate chloride, or any combinations thereof;
- copolymers of dimethylamine and epichlorohydrin;
- copolymers of dimethylamine and epichlorohydrin crosslinked with, for example, ethylene diamine;
- polymers of diallyldimethyl ammonium chloride (DADMAC);
- copolymers of diallyldimethyl ammonium chloride and acrylamide;
- copolymers of diallyldimethyl ammonium chloride, acrylamide, and glyoxal;
- polyvinylamine polymers, and copolymers thereof (e.g. vinylformamide-vinylamine copolymer);
- polymers and copolymers containing ethyleneimine, including for example those modified with polyethyleneglycol and epichlorohydrin;
- polycondensate of dicyandiamide and diethylenetriamine;
- polyamide-epichlorohydrin resin, such as produced from adipic acid, diethylenetriamine and epichlorohydrin or a mixture of epichlorohydrin with ammonia;
- polyhexamethylene-1,6-diisocyanate, such as modified with polyethyleneglycol monomethyl ether;
- copolymers of hexamethylenediamine and epichlorohydrin;
- copolymers of diethylenetriamine, adipic acid, such as modified with 2-aminoethanol and epichlorohydrin;
- N-[(dimethylamino)methyl]-acrylamide polymers with acrylamide and styrene;
- poly[acrylamide-acrylic acid-N-(dimethyl-aminomethyl) acryl-amide], such as produced by reacting polyacrylamide with dimethylamine and formaldehyde; and
- cationic starch such as treated with 3-chloro-2-hydroxypropyl trimethyl ammonium chloride or glycidyl trimethyl ammonium chloride to render it cationic, or any combinations thereof. These polymers and copolymers can be used individually or in blends thereof.

As an option, cationic polyamine of low molecular weight can be used, such as cationic polyamine having a weight average molecular weight of from about 2,000 daltons to about 500,000 daltons, or from about 5,000 daltons to about 250,000 daltons, or from about 10,000 daltons to about 200,000 daltons, or from about 25,000 daltons to about 150,000 daltons, or from about 40,000 daltons to about 125,000 daltons, or other values. The cationic polyamine of low molecular weight can comprise, for example, copolymers of dimethylamine and epichlorohydrin crosslinked with, for example, ethylene diamine, or copolymers of acrylamide and DADMAC, or combinations thereof. In an option, the low molecular weight cationic polyamine can be used in blends with other cationic polymers or copolymers of high molecular weight, such as, for example, high molecular weight copolymers containing acrylamide with a cationic monomer. The high molecular weight cationic polymers, such as the copolymers containing acrylamide with a cationic monomer, can have a weight average molecular weight, for example, of from about 500,000 daltons to about 8 million daltons, or from about 600,000 daltons to about 7 million daltons, or from about 750,000 daltons to about 6 million daltons, or from about 1 million daltons to about 5 million daltons, or from about 2 million to about 4 million daltons, or other values. For example, a blend of (1) a copolymer made from dimethylamine and epichlorohydrin, subsequently crosslinked with ethylene diamine (e.g., MW 50,000-100,000 daltons), and (2) a copolymer made from acrylamide and 3-(N,N,N-trimethylammonium)propylacrylamide (e.g., MW 2 million-4 million daltons), can be used as the cationic polymer. Another blend which can be used as a cationic polymer is a blend of (1) a copolymer made from acrylamide and diallyldimethyl ammonium chloride (DADMAC) (e.g., MW 50,000-500,000 daltons), and (2) a copolymer made from acrylamide and 3-(N,N,N-trimethylammonium)propylacrylamide (e.g., MW 2 million-4 million daltons).

As an option, the cationic polymer can be supplemented or replaced with an inorganic cationically charged compound. As an option, inorganic cationic coagulants can be used as a cationically charged compound. Inorganic cationic coagulants which can be used can be or include inorganic cationic chemicals (e.g., aluminum sulfate (alum), aluminum chloride, ferric chloride, ferric sulfate), cationic inorganic polymers (e.g., polyaluminum chloride (PAC) polyaluminum sulfate (PAS), polyaluminum sulfate silicate (PASS)), water-dispersible cationic mineral particles (e.g., cationic alumina mineral particles, a cationic colloidal silica sol), aluminum chlorohydrate (ACH), or any combinations thereof.

The anionic polymer can be, for example, an anionic homopolymer, an anionic copolymer, an anionic terpolymer, or any combinations thereof. As an option, the anionic polymers which can be used as an anionically charged compound to treat the pulp in methods of the present invention can be at least one of the following:

- polymers of acrylic acid or salts thereof (e.g., sodium, ammonium, or potassium salts thereof);
- homopolymers and copolymers of monomers such as acrylic acid, acrylamide, methacrylic acid, maleic anhydride, 2-acrylamido-2-methylpropane-sulfonic acid, acrylonitrile (optionally hydrolyzed), styrene, alkyl methacrylates, itaconic acid, aspartic acid, butyl acrylate and other acrylate esters, butadiene, methyl methacrylate, fumaric acid, vinyl acetate, or any combinations of these monomers;

copolymers of acrylic acid and any of the above monomers, cross-linked with N-methylene-bis(acrylamide);

sodium poly(isopropenylphosphonate);

styrene-maleic anhydride copolymer;

carboxymethylcellulose polymers and copolymers, or any combinations thereof. These polymers and copolymers can be used individually or in blends thereof.

As an option, anionic polymers and copolymers, such as polyacrylic acid polymers, can be used having a weight average molecular weight of from about 500 to about 10 million, or from about 750 to about 500,000, or from about 1,000 daltons to about 100,000 daltons, or from about 10,000 to about 90,000 daltons, or from about 20,000 to about 80,000 daltons, or from about 30,000 to about 75,000 daltons, or from about 50,000 to about 70,000 daltons, or other values.

As an option, the cationic polymer can be supplemented or replaced with an inorganic anionically charged compound. As an option, inorganic anionic coagulants can be used as an anionically charged compound, such as polyphosphates, anionic silica sol, or any combinations thereof.

As an option, the cationic or anionically charged compound also may be an amphoteric compound having a net cationic or anionic charge. As an option, the amphoteric compound can be at least one of the following:

a copolymer of acrylamide, 2-[(methacryloyloxy)ethyl]trimethyl ammonium chloride, N,N'-methylene bisacrylamide, and itaconic acid;

a copolymer of vinylformamide, vinylamine and acrylic acid;

a diallyldimethyl ammonium chloride polymer with acrylamide and potassium acrylate, or any combinations thereof.

As an option, the cationically charged compound (such as a cationic polymer, inorganic cationically charged compound, or both) can be added to the pulp in processes of the present invention, such as at the approach to the pulp dryer as illustrated or elsewhere after any bleaching and before the pulp dryer, in an amount from about 0.1 to about 10 pounds (lb.) cationically charged compound/ton dry fiber, or from about 0.2 to about 8 lb. cationically charged compound/ton dry fiber, or from about 0.3 to about 4 lb. cationically charged compound/ton dry fiber, or from about 0.5 to about 3 lb. cationically charged compound/ton dry fiber (on a solids/solids basis), and the anionically charged compound (such as a anionic polymer, inorganic anionically charged compound, or both) can be added to pulp in similar amounts. As an option, the cationically and anionically charged compounds can be added to the pulp in a total amount of from about 0.2 lb. ionically charged compounds/ton dry fiber to about 20 lb./ton dry fiber, or from about 0.4 to about 16 lb. ionically charged compounds/ton dry fiber, or from about 0.6 to about 8 lb. ionically charged compounds/ton dry fiber, or from about 1 to about 6 lb. ionically charged compounds/ton dry fiber (on a solids/solids basis), or other values. As an option, the cationically charged compound and the anionically charged compound can be added to the pulp in a weight ratio (w:w) of from about 1:10 to about 10:1, or from about 2.5:7.5 to 7.5:2.5, or from about 4:6 to about 6:4, or 5:5, or other ratios.

Wood chips suitable for use in the production of market pulp in the present invention can be derived from hardwood tree species, softwood tree species, or combinations thereof. Softwood tree species include, but not limited to: fir (such as Douglas fir and balsam fir), pine (such as Eastern white pine and Loblolly pine), spruce (such as white spruce), larch (such as Eastern larch), cedar, and hemlock (such as Eastern and Western hemlock). Examples of hardwood tree species include, but are not limited to: acacia, alder (such as red alder and European black alder), aspen (such as quaking aspen), beech, birch, oak (such as white oak), gum trees (such as eucalyptus and sweet gum), poplar (such as balsam poplar, Eastern cottonwood, black cottonwood, and yellow poplar), maple (such as sugar maple, red maple, silver maple, and big leaf maple). These types of woods can be used individually or in any combinations thereof. As an option, a combination of hemlock and cottonwood particulates can be used. As an option, the wood chips to be pulped include virgin wood material, such as at least 50% by weight up to 100% by weight virgin wood material. As an option, other pulpable material may be used or included in the feedstock, such as recycled fiber materials, such as recycled fiber from post-consumer waste, or non-wood materials, such as grasses, agricultural residues, bamboo, Bast materials (e.g., Ramie, flax, hemp), or any combinations thereof.

In addition to the cationically and anionically charged compounds, the pulps may be treated with one or more optional additives within the market pulp making system as long as they do not interfere with the indicated function of the cationically and anionically charged compounds to improve dewatering performance of the treated pulps. A list of optional chemical additives that can be used in conjunction with the present invention include, for example, pH modifiers, dry strength agents, wet strength agents, softening agents, debonding agents, adsorbency agents, sizing agents, dyes, optical brighteners, chemical tracers, opacifiers, dryer adhesive chemicals, and the like. Additional optional chemical additives may include, for example, pigments, emollients, humectants, viricides, bactericides, buffers, waxes, fluoropolymers, odor control materials and deodorants, zeolites, perfumes, vegetable and mineral oils, polysiloxane compounds, surfactants, moisturizers, UV blockers, antibiotic agents, lotions, fungicides, preservatives, aloe-vera extract, vitamin E, enzymes (e.g., cellulases, hemicellulases, lipases), or the like. Suitable optional chemical additives can be retained by the pulp fibers and may or may not be water soluble or water dispersible.

As indicated, the combined treatment of the pulp with the different types of charged compounds can provide significantly higher dewatering performance than when using either single chemistry treatment. In some options, though correlation of water retention with free drainage can vary with ionically charged compound type and application process, free drainage generally can demonstrate good correlation with water retention. In some options, increasing the dosage of the ionically charged compounds in the pulp can slightly reduce WRV and increase dewatering wherein the improvements ultimately can peak or level off with progressively increased dosages. In some options, at approximately 3 lb./ton dry fiber dosage rate for each type of the indicated ionically charged treatment compounds can provide approximately 80% of the maximal dewater value.

A market pulp product can be provided that includes the unitized pulp which has the cationically charged compound and anionically charged treatment compounds retained at least in part to the pulp fibers from the indicated treatment method. The market pulp made in processes according to the present invention can comprise, for example, from about 0.001 to about 5 pounds (lb.) cationically charged compound/ton dry fiber, or from about 0.01 to about 3 lb. cationically charged compound/ton dry fiber, or from about 0.1 to about 2 lb. cationically charged compound/ton dry fiber, or from about 0.2 to about 1 lb. cationically charged compound/ton dry fiber (on a solids/solids basis), and the anionically charged compound can be contained in the market pulp in similar amounts.

The present invention includes the following aspects/embodiments/features in any order and/or in any combination:

1. The present invention relates to a method for producing market pulp, comprising:

forming cellulosic particulates into pulp;

adding at least one cationically charged compound and at least one anionically charged compound to said pulp to provide treated pulp;

mechanically dewatering said treated pulp to provide mechanically dewatered pulp; and thermally drying said mechanically dewatered pulp to form market pulp.

2. The method of any preceding or following embodiment/feature/aspect, wherein at least part of said adding of said cationically charged compound to said pulp occurs prior to said adding of said anionically charged compound to said pulp.

3. The method of any preceding or following embodiment/feature/aspect, wherein about 80% to 100% of said adding of said cationically charged compound to said pulp occurs prior to said adding of said anionically charged compound to said pulp.

4. The method of any preceding or following embodiment/feature/aspect, wherein the cationically charged compound is an inorganic cationically charged compound, and the anionically charged compound is an inorganic anionically charged compound.

5. The method of any preceding or following embodiment/feature/aspect, wherein the cationically charged compound is a cationic polymer, and the anionically charged compound is an anionic polymer.

6. The method of any preceding or following embodiment/feature/aspect, further comprising bleaching the pulp after the pulp forming and before the adding of the cationically and anionically charged compounds to said pulp.

7. A method for producing market pulp, comprising:

forming cellulosic particulates into pulp;

adding at least one cationic polymer and at least one anionic polymer to said pulp to provide treated pulp effective to form a polyelectrolyte complex in said treated pulp;

mechanically dewatering said treated pulp to provide mechanically dewatered pulp; and thermally drying said mechanically dewatered pulp to form market pulp.

8. The method of any preceding or following embodiment/feature/aspect, wherein at least part of said adding of said cationic polymer to said pulp occurs prior to said adding of said anionic polymer to said pulp.

9. The method of any preceding or following embodiment/feature/aspect, wherein about 80% to 100% of said adding of said cationic polymer to said pulp occurs prior to said adding of said anionic polymer to said pulp.

10. The method of any preceding or following embodiment/feature/aspect, further comprising bleaching the pulp after the pulp forming and before the adding of the cationic and anionic polymers to said pulp.

11. The method of any preceding or following embodiment/feature/aspect, the cationic polymer is a copolymer containing acrylamide with a cationic monomer; a copolymer of dimethylamine and epichlorohydrin; a copolymer of dimethylamine and epichlorohydrin crosslinked with ethylene diamine; a polymer of dimethyldiallyl ammonium chloride; a copolymer of dimethyldiallyl ammonium chloride and acrylamide; a copolymer of dimethyldiallyl ammonium chloride, acrylamide, and glyoxal; a polyvinylamine polymer; a polyvinylamine copolymer; a polymer or copolymer containing ethyleneimine; a polycondensate of dicyandiamide and diethylenetriamine; a polyimide-epichlorohydrin resin; a polyhexamethylene-1,6-diisocyanate; a copolymer of hexamethylenediamine and epichlorohydrin; a copolymer of diethylenetriamine and adipic acid modified with 2-aminoethanol and epichlorohydrin; a N-[(dimethylamino)methyl]-acrylamide polymer with acrylamide and styrene; a poly [acrylamide-acrylic acid-N-(dimethyl-aminomethyl)acrylamide]; a cationic starch treated with 3-chloro-2-hydroxypropyl trimethyl ammonium chloride or glycidyl trimethyl ammonium chloride, or any combinations thereof.

12. The method of any preceding or following embodiment/feature/aspect, the anionic polymer is a polymer of acrylic acid or a salt thereof; a homopolymer or copolymer of one or more of acrylic acid, acrylamide, methacrylic acid, maleic anhydride, 2-acrylamido-2-methylpropane-sulfonic acid, acrylonitrile (optionally hydrolyzed), styrene, alkyl methacrylates, itaconic acid, aspartic acid, butyl acrylate and other acrylate esters, butadiene, methyl methacrylate, fumaric acid, and/or vinyl acetate; a copolymer of acrylic acid cross-linked with N-methylene-bis(acrylamide); sodium poly(isopropenylphosphonate); styrene-maleic anhydride copolymer; a carboxymethylcellulose polymer or copolymer, or any combinations thereof.

13. The method of any preceding or following embodiment/feature/aspect, wherein said forming provides kraft pulp, sulfite pulp, fluff pulp, dissolving pulp, bleached chemothermomechanical pulp, or any combinations thereof.

14. The method of any preceding or following embodiment/feature/aspect, further comprising bleaching the pulp after the pulp forming and before the adding of the cationic and anionic polymers to said pulp.

15. The method of any preceding or following embodiment/feature/aspect, wherein said mechanically dewatering comprises screening and pressing of the pulp, wherein drained white water from said screening is combined with fresh pulp and pumped with a fan pump to a head box for the screening, wherein cationic polymer is fed into the combined fresh pulp and white water before entering the fan pump, and said anionic polymer is fed into said combined fresh pulp and white water after exiting said fan pump and before reaching the headbox.

16. The method of any preceding or following embodiment/feature/aspect, wherein the anionic polymer and cationic polymer are added to the pulp in a ratio of from about 1:10 to about 10:1.

17. The method of any preceding or following embodiment/feature/aspect, wherein the anionic polymer and cationic polymer each are added to the pulp is added in an amount of from about 1 lb./ton dry fiber to about 10 lb./ton dry fiber.

18. The method of any preceding or following embodiment/feature/aspect, further comprising unitizing said market pulp to form unitized market pulp.

19. The method of any preceding or following embodiment/feature/aspect, wherein the cellulosic particulates are hardwood chips, softwood chips, recycled paper fiber, or any combinations thereof.

20. The method of any preceding or following embodiment/feature/aspect, wherein an amount of polyelectrolyte complex formed in said pulp is effective to provide at least one of the following:

(i) increased pulp free drainage (g/60 sec) to a value which is at least three times greater than free drainage value obtained without the complex formed/present in the pulp;

(ii) increased pulp free drainage to a value which is at least about 50% greater than free drainage value obtained with using the cationic polymer individually in the pulp without the anionic polymer;

(iii) increased pulp free drainage to a value which is at least about 10% greater than a free drainage value calculated as a sum of the free drainage increases obtained from using the anionic polymer and cationic polymer separately and individually in the pulp; and (iv) reducing pulp water retention value (WRV) to a value which is at least about 10% less than WRV obtained with using the cationic polymer individually in the pulp without the anionic polymer.

21. The method of any preceding or following embodiment/feature/aspect, wherein the amount of complex formed is effective for increasing obtained free drainage to a value which is at least five times greater than free drainage value obtained without the complex present in the pulp.

22. The method of any preceding or following embodiment/feature/aspect, wherein the amount of complex formed is effective for increasing obtained free drainage to a value which is from about 60% to about 200% greater than free drainage value obtained with using the cationic polymer individually in the pulp.

23. The method of any preceding or following embodiment/feature/aspect, wherein the cationic polymer comprises a combination of a cationic polyamine having a weight average molecular weight of no greater than about 500,000 daltons or both, with a copolymer containing acrylamide with a cationic monomer having a weight average molecular weight greater than 500,000 daltons.

24. The method of any preceding or following embodiment/feature/aspect, wherein an amount of polyelectrolyte complex formed in said pulp is effective to provide increased pulp free drainage of at least about 10% greater than a sum of the free drainage increases obtained from using the cationic polymers separately and individually in the pulp in sequential additions before the anionic polymer.

25. A market pulp made by the method of any preceding or following embodiment/feature/aspect containing said cationically charged compound and said anionically charged compound.

26. A market pulp made by the method of any preceding or following embodiment/feature/aspect containing said cationic polymer and said anionic polymer.

27. A system for producing market pulp comprising:

a supply of cellulosic particulates;

at least one pulp forming unit for forming pulp from said cellulosic particulates;

at least one feeding device for feeding at least one cationically charged compound to said pulp;

at least one feeding device for feeding at least one anionically charged compound to said pulp to provide treated pulp after addition of the both cationically and anionically charged compounds;

a mechanical dewatering device for mechanically removing water from said treated pulp to provide mechanically dewatered pulp; and a thermal drying device for thermally removing water from said mechanically dewatered pulp to provide market pulp.

28. The system of any preceding or following embodiment/feature/aspect, wherein said at least one feeding device for feeding cationically charged compound feeds cationic polymer and said at least one feeding device for feeding anionically charged compound feeds anionic polymer.

29. The system of any preceding or following embodiment/feature/aspect, wherein said pulp forming unit is a digester capable of receiving at least one chemical for digesting the cellulosic particulates.

30. The system of any preceding or following embodiment/feature/aspect, wherein said mechanical dewatering device comprises screen and press sections, wherein drained white water from the screen section is combinable with fresh pulp and pumpable with a fan pump to a head box of the mechanical dewatering device, wherein said at least one feeding device for said cationically charged compound is capable of feeding said cationically charged compound into the combined fresh pulp and white water before entering said fan pump, and said at least one feeding device for said anionically charged compound is capable of feeding said anionically charged compound into said combined fresh pulp and white water after exiting said fan pump and before reaching the headbox.

31. The system of any preceding or following embodiment/feature/aspect, further comprising a bleaching unit for bleaching the pulp after the pulp forming unit and before the adding of the cationically and anionically charged compounds to said pulp with said feeding devices.

32. The system of any preceding or following embodiment/feature/aspect, wherein the first and second feeding devices being capable of introducing respective first and second amounts of the cationic polymer and anionic polymer to pulp drawn from the pulp forming unit to provide an amount of polyelectrolyte complex in said pulp which provides at least one of the following:

(i) increased pulp free drainage (g/60 sec) to a value which is at least three times greater than free drainage value obtained without the complex formed/present in the pulp;

(ii) increased pulp free drainage to a value which is at least about 50% greater than free drainage value obtained with using the cationic polymer individually in the pulp without the anionic polymer;

(iii) increased pulp free drainage to a value which is at least about 10% greater than a free drainage value calculated as a sum of the free drainage increases obtained from using the anionic polymer and cationic polymer separately and individually in the pulp; and (iv) reducing pulp water retention value (WRV) to a value which is at least about 10% less than WRV obtained with using the cationic polymer individually in the pulp without the anionic polymer.

The present invention can include any combination of these various features or embodiments above and/or below as set forth in sentences and/or paragraphs. Any combination of disclosed features herein is considered part of the present invention and no limitation is intended with respect to combinable features.

The present invention will be further clarified by the following examples, which are intended to be only exemplary of the present invention. Unless indicated otherwise, all amounts, percentages, ratios and the like used herein are by weight.

EXAMPLES

Example 1

Experiments were conducted to compare water drainage of pulp treated using two single cationic polymers alone and their combination as sequentially added to the pulp before an anionic polymer, and water drainage of untreated pulp.

A bench scale test was conducted for the evaluation. As indicated, separate experiments were nm on pulps to compare the effects of using the different cationic polymers individually and in combination. A control test also was conducted with no chemical additive used on the pulp. The cationic polymers used for these experiments were a copolymer of acrylamide and DADMAC ("Cationic Polymer 1"), and cationic polyacrylamide ("Cationic Polymer 2"). Cationic Polymer 1 was a low molecular weight cationic polymer (MW<500,000 daltons), and Cationic Polymer 2 was a high molecular weight cationic polymer (MW 2-4 million daltons). The anionic polymer was a polyacrylic acid homopolymer (molecular weight 50,000-70,000 daltons). The dosage rate of cationic polymer used was 1.0 lb. of total active cationic polymer or polymers/ton dry pulp fiber with any combinations of cationic polymers added in approximately equal amounts. The dosage rate of anionic polymer, if used, was 0.4 lb. of anionic polymer/ton dry pulp fiber.

The following testing procedure was applied.

(1) A slurry of the pulp to be tested is prepared (about 2 percent by weight consistency in tap water).

(2) 800 mL of this pulp slurry is collected and warmed to 65-70° C.

(3) With agitation, polymers are added in the indicated sequence and amounts.

(4) After 30 seconds of additional stirring, the pulp slurry is poured into a Buchner funnel fitted with a section of metal screen (100-mesh). The water is allowed to drain freely. The amount of water removed from the slurry is measured at different time intervals. Free drainage rate in g/60 sec is determined based on the measurements.

Figure 4:
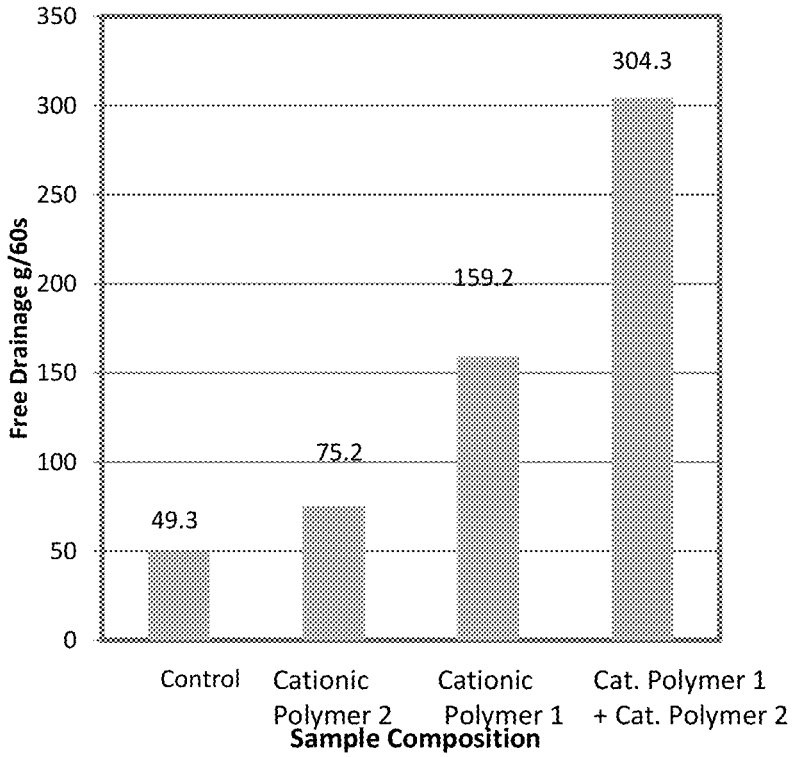
FIG. 4 shows a comparison of free water drainage (g/60 sec) in pulp treated with individual cationic and anionic polymers alone, and their combined use in pulp according to an example of the present application. The control sample of pulp was not treated with either polymer additive.

The results of these experiments are shown in FIG. 4. The results show that significant improvement in free drainage rate was obtained with the treatment of the pulp with the individual cationic polymers (i.e., "Cationic Polymer 2" or "Cationic Polymer 1") and with their combined use (i.e., "Cat. Polymer 1+Cat. Polymer 2"), which all exceeded the results for the Control (i.e., no polymer additive). Further, the water drainage result for the pulp treated with the combination of the different cationic polymers significantly exceeded the sum results of the individual free drainage amounts for the pulps when treated with each of the cationic polymers alone.

Example 2

Experiments were conducted to compare water drainage of pulp treated using sequential addition of cationic polymer and then anionic polymer to pulp treated with cationic polymer alone. Further, the effects on water drainage of using different ratios of two different cationic polymers for the cationic polymer were also studied.

The same types of cationic and anionic polymers, and the same drainage rate test procedure as used in Example 1 were used in these experiments.

Figure 5:
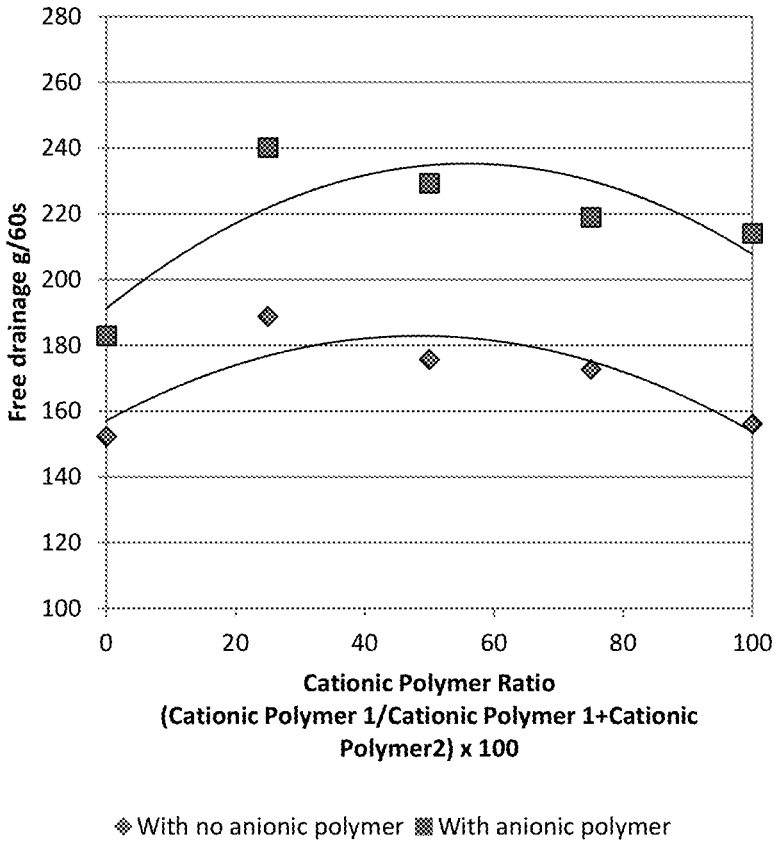
FIG. 5 shows a comparison of free water drainage (g/60 sec) in pulp treated with sequentially added cationic polymer and anionic polymer, in that order, as compared to treatment with pulp only with the cationic polymer without the anionic polymer.

The results of these experiments are shown in FIG. 5. With respect to the "Cationic Polymer Ratio" in FIG. 5, the endpoint values of "0" and "100" on the x-axis of the bar graph in FIG. 5 refer to the percentage of Cationic Polymer 1 alone (i.e., "0" on the x-axis corresponds to pulp treated with 0% Cationic Polymer 1, 100% Cationic Polymer 2, and "100" on the x-axis corresponds to pulp treated with 100% Cationic Polymer 1, 0% Cationic Polymer 2). The intervening values of Cationic Polymer Ratio between 0 and 100 on the x-axis of FIG. 5 represent polymer ratio values for use of both Cationic Polymer 1 and Cationic Polymer 2 in treatment of pulps, which, as indicated in the figure, are calculated as the ratio of the amount of Cationic Polymer 1 divided by the total amount of Cationic Polymer 1 and Cationic Polymer 2. As also indicated in FIG. 5, the calculated Cationic Polymer Ratio value is multiplied by 100 to provide a whole number result. The results show significant improvement in free drainage rate obtained with the treatment of the pulp with the sequentially added cationic and anionic polymers which exceeds the results for the pulps treated with the cationic polymer alone, at all cationic polymer ratio values where tested.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method for producing market pulp, comprising:

forming cellulosic particulates into pulp;

adding at least one cationic polymer and at least one anionic polymer to said pulp to provide treated pulp effective to form a polyelectrolyte complex in said treated pulp;

mechanically dewatering said treated pulp to provide mechanically dewatered pulp; and thermally drying said mechanically dewatered pulp to form market pulp, wherein the amount of complex formed is effective for increasing obtained free drainage to a value which is from about 60% to about 200% greater than free drainage value obtained with using the cationic polymer individually in the pulp.

2. The method of claim 1, wherein at least part of said adding of said cationic polymer to said pulp occurs prior to said adding of said anionic polymer to said pulp.

3. The method of claim 1, wherein about 80% to 100% of said adding of said cationic polymer to said pulp occurs prior to said adding of said anionic polymer to said pulp.

4. The method of claim 1, further comprising bleaching the pulp after the pulp forming and before the adding of the cationic and anionic polymers to said pulp.

5. The method of claim 1, the cationic polymer is a copolymer containing acrylamide with a cationic monomer; a copolymer of dimethylamine and epichlorohydrin; a copolymer of dimethylamine and epichlorohydrin crosslinked with ethylene diamine; a polymer of dimethyldiallyl ammonium chloride; a copolymer of dimethyldiallyl ammonium chloride and acrylamide; a copolymer of dimethyldiallyl ammonium chloride, acrylamide, and glyoxal; a polyvinylamine polymer; a polyvinylamine copolymer; a polymer or copolymer containing ethyleneimine; a polycondensate of dicyandiamide and diethylenetriamine; a polyamide-epichlorohydrin resin; a polyhexamethylene-1,6-diisocyanate; a copolymer of hexamethylenediamine and epichlorohydrin; a copolymer of diethylenetriamine and adipic acid modified with 2-aminoethanol and epichlorohydrin; a N-[(dimethylamino)methyl]-acrylamide polymer with acrylamide and styrene; a poly [acrylamide-acrylic acid-N-(dimethyl-aminomethyl)acrylamide]; a cationic starch treated with 3-chloro-2-hydroxypropyl trimethyl ammonium chloride or glycidyl trimethyl ammonium chloride, or any combinations thereof.

6. The method of claim 1, the anionic polymer is a polymer of acrylic acid or a salt thereof; a homopolymer or copolymer of one or more of acrylic acid, acrylamide, methacrylic acid, maleic anhydride, 2-acrylamido-2-methylpropane-sulfonic acid, acrylonitrile (optionally hydrolyzed), styrene, alkyl methacrylates, itaconic acid, aspartic acid, butyl acrylate and other acrylate esters, butadiene, methyl methacrylate, fumaric acid, and/or vinyl acetate; a copolymer of acrylic acid cross-linked with N-methylene-bis(acrylamide); sodium poly(isopropenylphosphonate); styrene-maleic anhydride copolymer; a carboxymethylcellulose polymer or copolymer, or any combinations thereof.

7. The method of claim 1, wherein said forming provides kraft pulp, sulfite pulp, fluff pulp, dissolving pulp, bleached chemothermomechanical pulp, or any combinations thereof.

8. The method of claim 1, wherein said mechanically dewatering comprises screening and pressing of the pulp, wherein drained white water from said screening is combined with fresh pulp and pumped with a fan pump to a head box for the screening, wherein cationic polymer is fed into the combined fresh pulp and white water before entering the fan pump, and said anionic polymer is fed into said combined fresh pulp and white water after exiting said fan pump and before reaching the headbox.

9. The method of claim 1, wherein the anionic polymer and cationic polymer are added to the pulp in a ratio of from about 1:10 to about 10:1.

10. The method of claim 1, wherein the anionic polymer and cationic polymer each are added to the pulp is added in an amount of from about 1 lb./ton dry fiber to about 10 lb./ton dry fiber.

11. The method of claim 1, further comprising unitizing said market pulp to form unitized market pulp.

12. The method of claim 1, wherein the cellulosic particulates are hardwood chips, softwood chips, recycled paper fiber, or any combinations thereof.

13. The method of claim 1, wherein an amount of polyelectrolyte complex formed in said pulp is effective to provide at least one of the following:

(i) increased pulp free drainage (g/60 sec) to a value which is at least three times greater than free drainage value obtained without the complex formed/present in the pulp;

(ii) increased pulp free drainage to a value which is at least about 50% greater than free drainage value obtained with using the cationic polymer individually in the pulp without the anionic polymer;

(iii) increased pulp free drainage to a value which is at least about 10% greater than a free drainage value calculated as a sum of the free drainage increases obtained from using the anionic polymer and cationic polymer separately and individually in the pulp; and (iv) reducing pulp water retention value (WRV) to a value which is at least about 10% less than WRV obtained with using the cationic polymer individually in the pulp without the anionic polymer.

14. The method of claim 1, wherein the amount of complex formed is effective for increasing obtained free drainage to a value which is at least five times greater than free drainage value obtained without the complex present in the pulp.

15. The method of claim 1, wherein the cationic polymer comprises a combination of a cationic polyamine having a weight average molecular weight of no greater than about 500,000 daltons or both, with a copolymer containing acrylamide with a cationic monomer having a weight average molecular weight greater than 500,000 daltons.

16. The method of claim 15, wherein an amount of polyelectrolyte complex formed in said pulp is effective to provide increased pulp free drainage of at least about 10% greater than a sum of the free drainage increases obtained from using the cationic polymers separately and individually in the pulp in sequential additions before the anionic polymer.

17. A method for producing market pulp, comprising:

forming cellulosic particulates into pulp;

adding at least one cationic polymer and at least one anionic polymer to said pulp to provide treated pulp effective to form a polyelectrolyte complex in said treated pulp;

mechanically dewatering said treated pulp to provide mechanically dewatered pulp;

thermally drying said mechanically dewatered pulp to form market pulp;

wherein an amount of polyelectrolyte complex formed in said pulp is effective to provide at least one of the following:

(i) increased pulp free drainage (g/60 sec) to a value which is at least three times greater than free drainage value obtained without the complex formed/present in the pulp;

(ii) increased pulp free drainage to a value which is at least about 50% greater than free drainage value obtained with using the cationic polymer individually in the pulp without the anionic polymer;

(iii) increased pulp free drainage to a value which is at least about 10% greater than a free drainage value calculated as a sum of the free drainage increases obtained from using the anionic polymer and cationic polymer separately and individually in the pulp; and (iv) reducing pulp water retention value (WRV) to a value which is at least about 10% less than WRV obtained with using the cationic polymer individually in the pulp without the anionic polymer.

18. The method of claim 17, further comprising bleaching the pulp after the pulp forming and before the adding of the cationic and anionic polymers to said pulp.

19. A method for producing market pulp, comprising:

forming cellulosic particulates into pulp;

adding at least one cationic polymer and at least one anionic polymer to said pulp to provide treated pulp effective to form a polyelectrolyte complex in said treated pulp;

mechanically dewatering said treated pulp to provide mechanically dewatered pulp;

thermally drying said mechanically dewatered pulp to form market pulp;

wherein the cationic polymer comprises a combination of a cationic polyamine having a weight average molecular weight of no greater than about 500,000 daltons or both, with a copolymer containing acrylamide with a cationic monomer having a weight average molecular weight greater than 500,000 daltons; and wherein an amount of polyelectrolyte complex formed in said pulp is effective to provide increased pulp free drainage of at least about 10% greater than a sum of the free drainage increases obtained from using the cationic polymers separately and individually in the pulp in sequential additions before the anionic polymer.

* * * * *